US006921152B2

(12) United States Patent
Fukunaga et al.

(10) Patent No.: US 6,921,152 B2
(45) Date of Patent: Jul. 26, 2005

(54) INK JET RECORDING HEAD AND METHOD FOR MANUFACTURING THE SAME

(75) Inventors: Hideki Fukunaga, Ebina (JP); Hiroyuki Usami, Ebina (JP); Hiroshi Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/629,652

(22) Filed: Jul. 30, 2003

(65) Prior Publication Data

US 2004/0109040 A1 Jun. 10, 2004

(30) Foreign Application Priority Data

Dec. 6, 2002 (JP) ..... 2002-354824

(51) Int. Cl.[7] ..... B41J 2/135
(52) U.S. Cl. ..... 347/44
(58) Field of Search ..... 347/20, 44, 54, 347/61–63; 216/27

(56) References Cited

U.S. PATENT DOCUMENTS 5,458,254 A * 10/1995 Miyagawa et al. ..... 216/27

FOREIGN PATENT DOCUMENTS

| | | |
|---|---|---|
| JP | 10-157150 | 6/1998 |
| JP | 11-138817 | 5/1999 |

* cited by examiner

*Primary Examiner*—Stephen D. Meier
*Assistant Examiner*—An H. Do
(74) *Attorney, Agent, or Firm*—Morgan, Lewis & Bockius LLP

(57) ABSTRACT

In order to that there is no region in which an ink pools, a particle made from the ink is hardly generated, and high reliability is archived, an ink jet recording head comprising a substrate; a resin body, which defines an ink discharge section, formed on the substrate; and a heating resistor provided on the substrate, an ink chamber being formed between the heating resistor and the ink discharge section, resin parts being positioned in the resin body along the ink chamber, a material of the resin part being the same as that of the resin body, is provided.

5 Claims, 7 Drawing Sheets

INK JET RECORDING HEAD AND METHOD FOR MANUFACTURING THE SAME

CROSS-REFERENCE TO RELATED APPLICATION

This application claims priority under 35 USC 119 from Japanese Patent Application No. 2002-354824, the disclosure of which is incorporated by reference herein.

BACKGROUND OF THE INVENTION

1. Field of the Invention

The present invention relates to an ink jet recording head, and a method for manufacturing the ink jet recording head.

2. Description of the Related Art

A mold (male type) for an ink channel (path) is formed on a substrate by using a resin having solubility. Thereafter, the mold is coated with a covering resin to form an ink discharge surface (an orifice plate). At this state, a surface of the covering resin rises in a convex shape on the male mold for the ink channel due to surface tension and the like. That is, the surface of the covering resin does not become flat. This non-flat surface of the covering resin is not desired when forming of an ink discharging hole. Therefore, conventionally, as a method for manufacturing an ink jet recording head, technique mentioned below was proposed.

A pattern for forming an ink channel and also a pattern serving as a base are formed from a resin layer having solubility on a substrate. As a result, when a covering resin is coated on those patterns, the covering layer, which will becomes an orifice plate, on the resin layer having solubility, is made to be flat by the base (for example, see Japanese Patent Application Laid-Open (JP-A) No. 10-157150, FIG. 1).

That is, as shown in FIG. 11, when a pattern for forming an ink channel 210 is formed from a resin layer having solubility (not shown in the drawings) on a substrate 200 on which heating resistors 202 are formed, a base is also formed in the vicinity of the ink channel 210 (the pattern for forming an ink channel 210) from the resin layer having solubility (not shown in the drawings) on the substrate 200. As a result, the resin layer 204, which will become an ink discharging surface, on the resin layer having solubility can be flatly formed. Next, ink discharge openings 206 are formed on the resin layer 204. Together with this, the resin layer 204 on the base is removed. Thereafter, an ink supplying opening 208 is formed on the substrate 200. Then, the resin layer serving as the pattern for forming the ink channel 210 and also the resin layer serving as the base are solved out (eluted), and a hole 212 is formed.

Or, in addition to the technique mentioned above, it is proposed that a penetration opening provided on a covering resin layer is formed so as to have a dimension which is sufficiently larger than that of the base in order to remove the resin, having solubility, serving as the base (for example, see Japanese Patent Application Laid-Open (JP-A) No. 11-138817, FIG. 1).

In those technique mentioned above, the base is formed form the resin having solubility which is the same resin of the pattern for forming the ink channel 210. Accordingly, it is necessary to remove this resin having solubility (the base) because there is a risk of cracking due to difference between coefficients of thermal expansions of this resin having solubility and the covering resin layer 204.

However, in those technique mentioned above, because a region which in not covered by the resin (the hole 212) is formed on a surface of the manufacturing-completed ink head, a region between the substrate 200 and the resin layer 204 is eroded by an ink splashed from the ink discharge hole 206, as a result, adhesion of the resin layer 204 deteriorates. Or, the ink pools at the region. These cause dust.

SUMMARY OF THE INVENTION

In view of the aforementioned circumstances, an object of the present invention is to provide an ink jet recording head in which a covering resin layer serving as an ink discharging surface can be flatly formed, there is not dusty, therefore high reliability is archived, and also provide a method for manufacturing the ink jet recording head.

A first aspect of the present invention is an ink jet recording head comprising: a substrate; a resin body, which defines an ink discharge section, formed on the substrate; and a heating resistor provided on the substrate, an ink chamber being formed between the heating resistor and the ink discharge section, wherein resin parts are positioned in the resin body along the ink chamber, a material of the resin part being the same as that of the resin body.

In the structure of the invention mentioned above, the material of the resin parts, which are positioned (embedded) in the resin body along the ink chamber, are the same as that of the resin body. Preferably, the resin parts are positioned in the resin body at both sides of the ink chamber. That is, the resin parts are arranged along a longitudinal direction of the ink chamber, namely, a direction in which the ink discharge sections are arranged. Therefore, it is not necessary to remove the resin part in manufacturing of the ink jet recording head. Accordingly, a surface of the resin body forming the ink chamber can be flatly formed, there is not dusty, therefore high reliability is archived. Together with this, it can be archived that there is no region in which the resin does not cover the surface of the ink head.

As a result, the ink jet recording head in which there is no region in which the ink pools, a particle made from the ink is hardly generated, and high reliability is archived, can be provided.

A second aspect of the present invention is a method of manufacturing an ink jet recording head comprising the steps of: forming a first resin body on a substrate on which a heating resistor is provided, the first resin body covering the heating resistor; forming a second resin body along the first resin body; forming a third resin covering the first resin body and the second resin body, a material of the third resin being the same as that of the second resin body; defining an ink discharge section by removing a part of the third resin body; and forming an ink chamber in which the heating resistor is exposed, by removing the first resin body.

In the structure of the invention mentioned above, because the material of the third resin body covering the first resin body and the second resin body is the same as that of the second resin body. Therefore, it is not necessary to remove the second resin body after forming the ink discharge section on the third resin body. Accordingly, a surface of the third resin body can be flatly formed. Together with this, it can be archived that there is no region in which the resin does not cover the surface of the ink head.

As a result, the ink jet recording head in which there is no region in which the ink pools, a particle made from the ink is hardly generated, and high reliability is archived, can be provided.

A third aspect of the present invention is an ink jet cartridge comprising an ink jet recording head comprising a substrate; a resin body, which defines an ink discharge section, formed on the substrate; and a heating resistor provided on the substrate, an ink chamber being formed between the heating resistor and the ink discharge section, wherein resin parts are positioned in the resin body along the ink chamber, a material of the resin part being the same as that of the resin body; and an ink tank.

In the structure of the invention mentioned above, the material of the resin parts, which are positioned in the resin body along the ink chamber, are the same as that of the resin body. Therefore, it is not necessary to remove the base resin in manufacturing of the ink jet recording head. Accordingly, a surface of the resin body forming the ink chamber can be flatly formed, there is not dusty, therefore high reliability is archived. Together with this, it can be archived that there is no region in which the resin does not cover the surface of the ink head.

As a result, the ink jet cartridge provided with the ink jet recording head in which there is no region in which the ink pools, a particle made from the ink is hardly generated, and high reliability is archived, and the ink tank which is integrated with the ink jet recording head or is separated from the ink jet recording head, can be provided.

A fourth aspect of the present invention is an ink jet printer comprising an ink jet recording head comprising: a substrate; a resin body, which defines an ink discharge section, formed on the substrate; and a heating resistor provided on the substrate, an ink chamber being formed between the heating resistor and the ink discharge section, wherein resin parts are positioned in the resin body along the ink chamber, a material of the resin part being the same as that of the resin body.

In the structure of the invention mentioned above, the material of the resin parts, which are positioned in the resin body along the ink chamber, are the same as that of the resin body. Therefore, it is not necessary to remove the base resin in manufacturing of the ink jet recording head. Accordingly, a surface of the resin body forming the ink chamber can be flatly formed, there is not dusty, therefore high reliability is archived. Together with this, it can be archived that there is no region in which the resin does not cover the surface of the ink head.

As a result, the ink jet recording head in which there is no region in which the ink pools, a particle made from the ink is hardly generated, and high reliability is archived, also the jet printer includes the ink jet recording head, can be provided.

In a fifth aspect of the present invention according to the second aspect of the invention, the second resin body and the third resin body are photosensitive resins.

In a sixth aspect of the present invention according to the fifth aspect of the invention, the ink discharge section is defined (formed) in the third resin body by photolithography.

In a seventh aspect of the present invention according to the second aspect of the invention, the second resin body and the third resin body are non-photosensitive resins.

In an eighth aspect of the present invention according to the seventh aspect of the invention, the ink discharge section is defined (formed) in the third resin body by dry-etching.

In a ninth aspect of the present invention according to the second aspect of the invention, a region of the third resin body, apart from the ink chamber by a predetermined distance, is entirely removed.

In a tenth aspect of the present invention according to the second aspect of the invention, a region of the third resin body, apart from the ink chamber by a predetermined distance, is removed by a predetermined amount (the predetermined amount of the third resin is removed).

In an eleventh aspect of the present invention according to the second aspect of the invention, the region of the third resin body, apart from the ink chamber by the predetermined distance, is removed by dry-etching at a time of defining (forming) the ink discharge section.

DETAILED DESCRIPTION OF THE INVENTION

Figure 1:
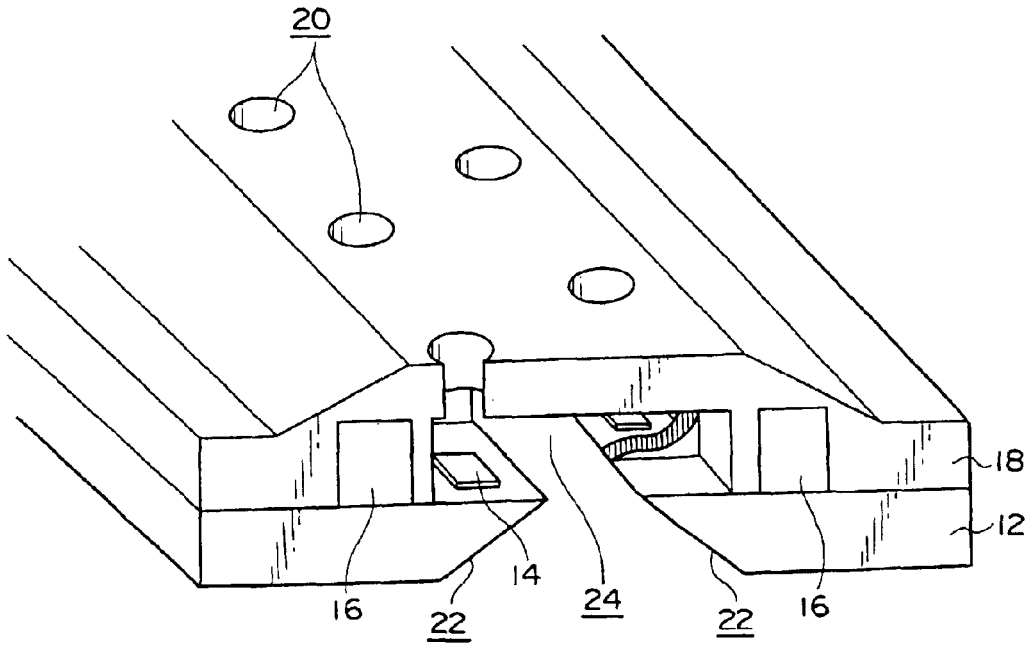
FIG. 1 is a perspective view of an ink jet recording head relating to a first embodiment of the present invention.

In FIG. 1, a perspective view of an ink jet recording head 10 relating to a first embodiment of the present invention is shown.

As shown in FIG. 1, a resin body 18 having an ink discharge sections 24 and heating resistors 14 are provided on a substrate 12. A ink chamber 24 is formed between the heating resistor 14 and the ink discharge section 20.

A resin part (resin body) 16 comprised of (made of ) the material which is the same as that of the resin body 18 is buried, in the vicinity of the ink chamber 24, within the resin body 18.

An ink supplying opening 22 is provided on the substrate 12. The ink supplying opening 22 supplies an ink to the ink chamber 24.

Because the ink jet recording head 10 of the first embodiment has the structure mentioned above, in the vicinity of the ink chamber 24, there is no region on which the resin body 18 does not cover. As a result, there is not dusty in the ink jet recording head. Therefore, the ink jet recording head of high reliability can be provided.

Here, the heating resistors 14 are arranged in two lines in a longitudinal direction of the ink jet recording head 10 at equal intervals. In addition, the heating resistors 14 are arranged in zigzag manner. That is, an one line of the two lines is shifted in the longitudinal direction with respect to the other of the two lines by a distance of a half of the interval of the heating resistors 14, in the longitudinal direction. As a result, resolution of an ink-image in the longitudinal direction in this case can be made twice as large as that of one line of the heating resistors 14. For example, in a case in which the resolution of the one line of the heating resistors 14 in the longitudinal direction is 600 dpi, the resolution of the two lines of the heating resistors 14 arranged in the zigzag manner becomes 1200 dpi.

Figure 2:
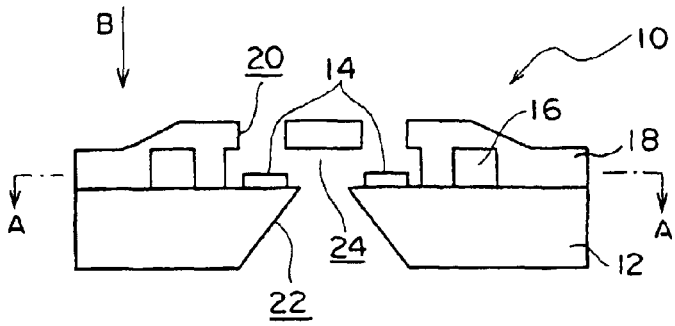
FIG. 2 is a cross sectional view of the ink jet recording head relating to the first embodiment of the present invention.
Figure 3:
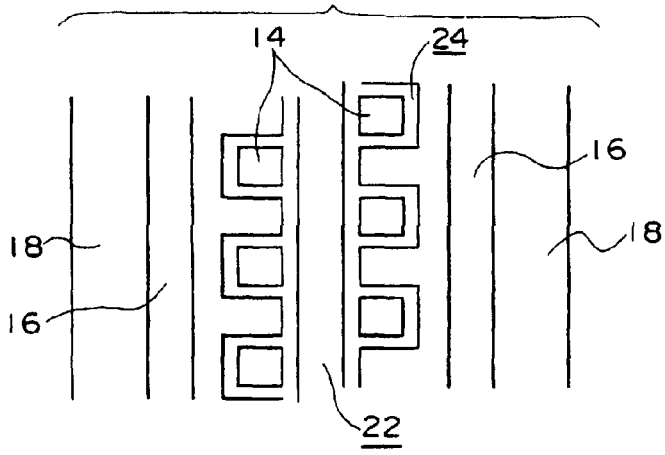
FIG. 3 is an internal plane view of the ink jet recording head relating to the first embodiment of the present invention.
Figure 4:
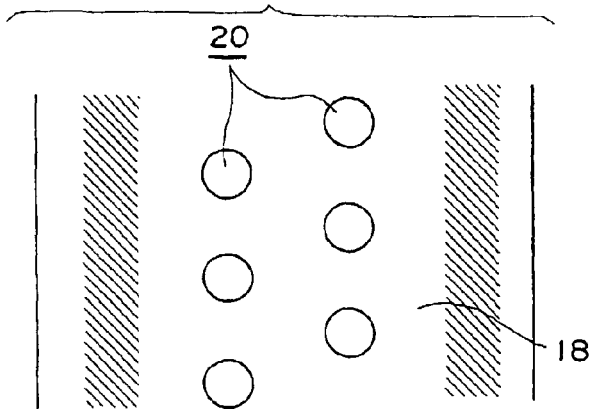
FIG. 4 is a plane view of the ink jet recording head relating to the first embodiment of the present invention.

In FIG. 2, a cross sectional view of the ink jet recording head 10 relating to the first embodiment of the present invention is shown. In FIG. 3, a plane view, when a cross section, cut with a broken line A in FIG. 2, is seen from a direction indicated by an arrow B, is shown. In addition, a plane view, when the ink jet recording head 10 is seen from the direction indicated by the arrow B, is shown in FIG. 4.

In FIGS. 5A–5F, cross sectional views indicating a first manufacturing method of the ink jet recording head 10 relating to the first embodiment are shown.

Figure 5A:
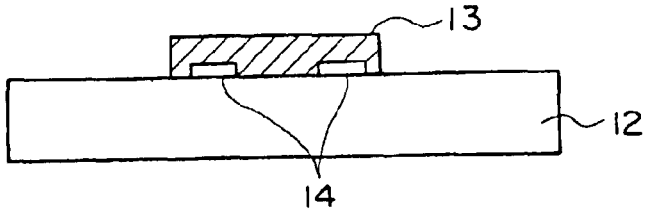
FIGS. 5A to 5F are cross sectional views which show manufacturing processes of (a first method for manufacturing) the ink-jet recording head of the present invention.

As shown in FIG. 5A, a resist of thick thickness having photosensitivity (hereinafter, a thick film resist) is coated in a spin manner on the substrate 12 on which the heating resistors 14 are provided. A pattern 13 of the thick film resist, which will serve as a mold for the ink chamber 24, is formed on the substrate 12 by photolithography.

In this method, the pattern is formed by the thick film resist having photosensitivity being subject to photolithography. However, the thick film resist having non-photosensitivity may be used. In a case in which the thick film resist having non-photosensitivity is used, an oxidation-resistant plasma resist is coated on the thick film resist having non-photosensitivity, a pattern which will serve as a mold for the ink chamber 24 is formed from the oxidation-resistant plasma resist by photolithography, and with the oxidation-resistant plasma resist being used as a mask, the thick film resist having non-photosensitivity is dry-etched by using oxide-plasma. Thereafter, the oxidation-resistant plasma resist is removed. Thus, the pattern 13 of the thick film resist shown in FIG. 5A is formed on the substrate 12.

Figure 5B:
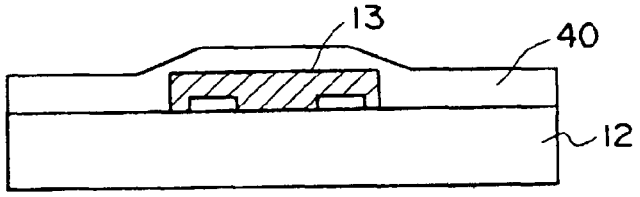

Next, as shown in FIG. 5B, a resin 40 having photosensitivity is coated in a spin manner on the substrate 12 on which the pattern 13 of the thick film resist is formed.

Figure 5C:
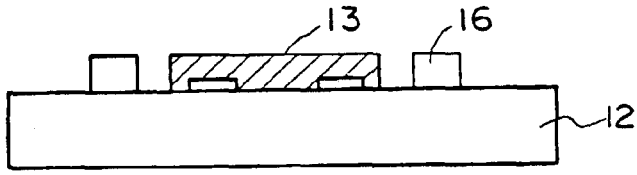

Further, as shown in FIG. 5C, the parts (bases) 16 are formed by patterning the coated resin 40 having photosensitivity by photolithography.

Figure 5D:
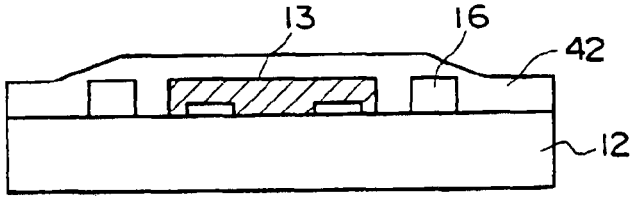

Next, as shown in FIG. 5D, a resin 42 having photosensitivity, which is the same material as that of the resin 40 having photosensitivity, is coated in a spin manner on the substrate 12 on which the pattern 13 of the thick film resist and the bases 16 are formed.

Figure 5E:
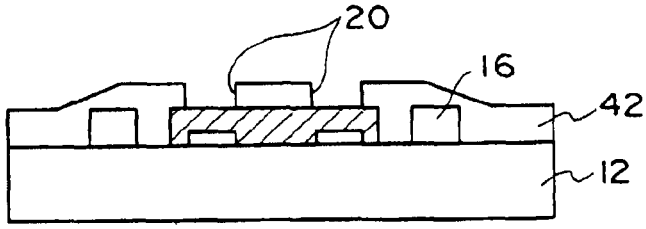

Further, as shown in FIG. 5E, the ink discharge sections 20 are formed on the resin 42 having photosensitivity by photolithography.

After surface processes mentioned above, as shown in FIG. 5F, the ink supply opining 22 for supplying the ink is formed on the substrate 12 by carrying out etching from a back side of the substrate 12. Next, the pattern 13 of the thick film resist is removed by dipping the substrate 12 in a thick film resist remover liquid. As a result, the ink chamber 24, from the ink supply opening 22 to the ink discharge section 20, is formed, Because the first manufacturing method of the ink jet recording head has the structure mentioned above, in the vicinity of the ink chamber 24, a region on which the resin body 42 does not cover does not exist. As a result, there is not dusty in the ink jet recording head. Therefore, the ink jet recording head of high reliability can be provided.

Figure 6A:
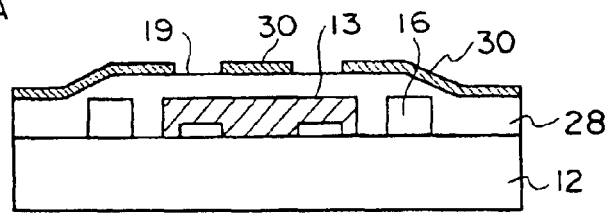
FIGS. 6A and 6B are cross sectional views which show manufacturing processes of (a second method for manufacturing) the ink-jet recording head of the present invention.
Figure 6B:
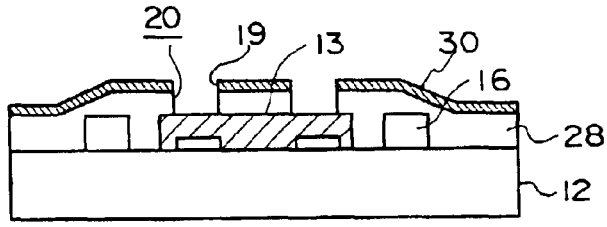

In FIGS. 6A and 6B, cross sectional views indicating a second manufacturing method of the ink jet recording head are shown.

In the first method mentioned above, the ink discharge sections 20 are formed on the resin 42 having photosensitivity by photolithography. However, instead of using the resin having photosensitivity, a resin having non-photosensitivity may be used.

A manufacturing method in which the resin having non-photosensitivity is used, as the second manufacturing method, will be explained.

Processes, from the process shown in FIG. 5A to the process shown in FIG. 5D (that is, until the process in which the resin is coated in a spin manner on the substrate 12 on which the pattern 13 of the thick film resist and the bases 16 are formed), are carried out in the similar way of the first method. However, note that the resin, from which the base 16 is formed, and the resin which is coated on the resin from which the base 16 is formed, are non-photosensitive resins.

As shown in FIG. 6A, a resin 28 having non-photosensitivity, which is the same material as that of the base 16, is coated in a spin manner on the substrate 12 on which the pattern 13 of the thick film resist and the bases 16 are formed. An oxidation-resistant plasma resist having photosensitivity 30 is coated on the resin 28 having non-photosensitivity. Then, a pattern 16 for forming the ink discharge sections 20 is formed from the oxidation-resistant plasma resist having photosensitivity 30 by photolithography.

Next, as shown in FIG. 6B, with the pattern 19 of the oxidation-resistant plasma resist being used as a mask, the resin 28 having non-photosensitivity is dry-etched by using oxide-plasma. Thus, the ink discharge sections 20 are formed.

Figure 5F:
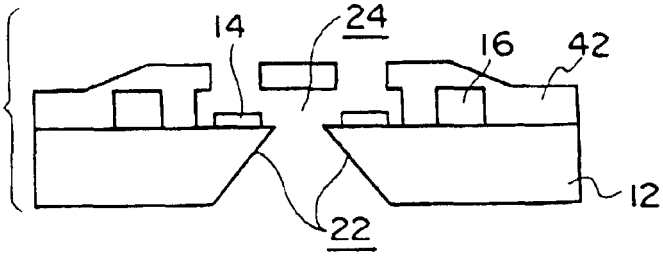

Thereafter, the oxidation-resistant plasma resist 30 is removed, the ink supply opining 22 is formed on the substrate 12 by carrying out etching from a back side of the substrate 12, in the similar way of the first method as shown in FIG. 5F. Next, the pattern 13 of the thick film resist is removed by dipping the substrate 12 in a thick film resist remover liquid. As a result, the ink chamber 24, from the ink supply opening 22 to the ink discharge section 20, is formed, In FIG. 7, a cross sectional view of an ink jet recording head relating to a second embodiment of the present invention is shown.

Figure 7:
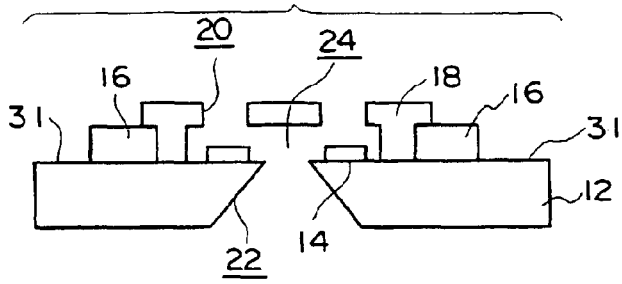
FIG. 7 is a cross sectional view of the ink jet recording head relating to a second embodiment of the present invention.

In the ink jet recording head relating to the first embodiment (the first manufacturing method) mentioned above, when the ink discharge sections 20 are formed on the resin 42 having photosensitivity, only portions of the resin 42 having photosensitivity, corresponding to the ink discharge sections 20, are removed, thus holes are formed. However, as shown in FIG. 7, removed regions 31 in which the resin 42 having photosensitivity is removed can be provided at an outside the ink chamber 24 (not in the vicinity of the ink chamber 24) according to demand.

As a result, due to providing the removed regions 31 in which the resin 42 having photosensitivity does not cover the substrate at positions apart from the ink discharge sections 20, failure of the ink jet recording head, such as cracking caused by a difference between coefficients of thermal expansions of the substrate 12 and the resin having photosensitivity 42 (and the base 16), can be prevented.

Figure 8A:
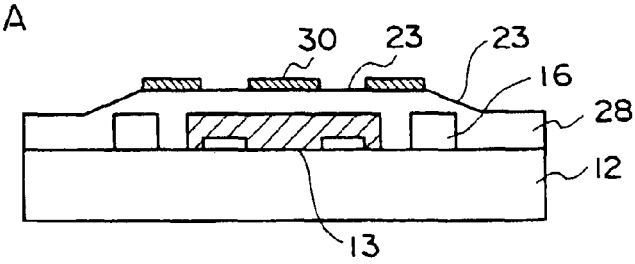
FIGS. 8A and 8B are cross sectional views which show manufacturing processes of (a third method for manufacturing) the ink-jet recording head relating to a third embodiment of the present invention.
Figure 8B:
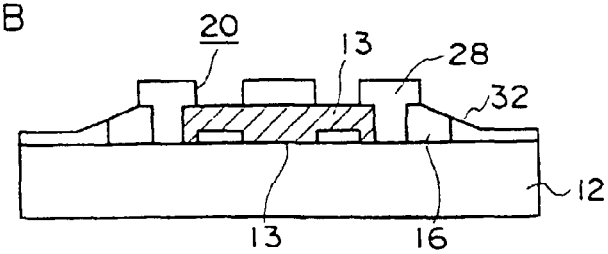

In FIGS. 8A and 8B, cross sectional views of an ink jet recording head relating to a third embodiment (a third manufacturing method) of the present invention are shown.

In the ink jet recording head relating to the second manufacturing method shown in FIGS. 6A and 6B mentioned above, when the ink discharge sections 20 are formed on the resin 28 having non-photosensitivity, only portions of the resin 28 having non-photosensitivity, corresponding to the ink discharge sections 20, are removed by dry-etching. However, a removed region 32 in which the resin 28 having non-photosensitivity is removed can be provided at an outside the ink chamber 24 (not in the vicinity of the ink chamber 24) according to demand. Note that, in this case, the removed region 32 is a region in which all resin 28 is not removed. That is, it is different from the removed region 31 shown in FIG. 7.

As shown in FIG. 8A, a pattern 23 in which portions corresponding to the ink discharge sections 20 and the regions outside the ink chamber 24 are open is formed form the oxidation-resistant plasma resist 30. Then, with the pattern 23 being used as a mask, the resin is dry-etched.

Next, as shown in FIG. 8B, the removed region 32 in which the resin 28 having non-photosensitivity is removed is formed at the region outside the pattern 13 of the thick film resist (the ink chamber 24) by removing the oxidation-resistant plasma resist 30. Also, the ink discharge sections 20 are formed.

Figure 9A:
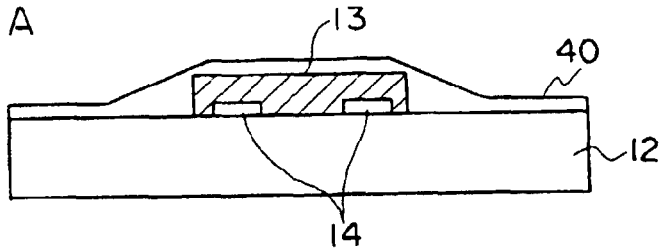
FIGS. 9A and 9E are cross sectional views which show manufacturing processes of (a fourth method for manufacturing) the ink jet recording head relating to a fourth embodiment of the present invention.
Figure 9B:
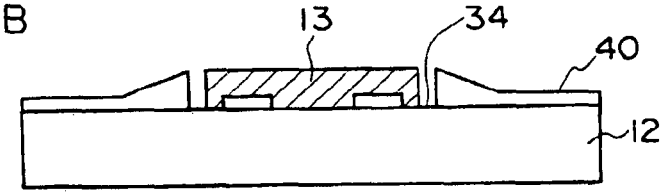
Figure 9C:
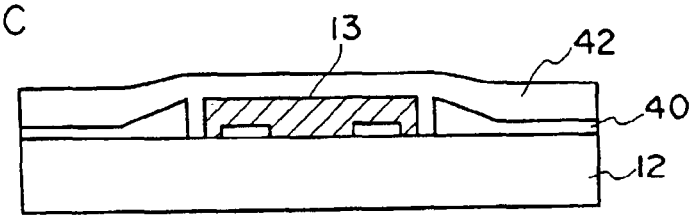
Figure 9D:
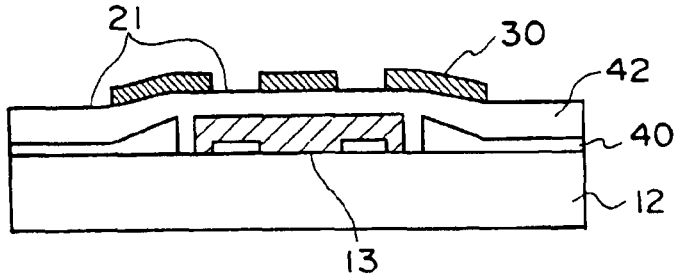
Figure 9E:
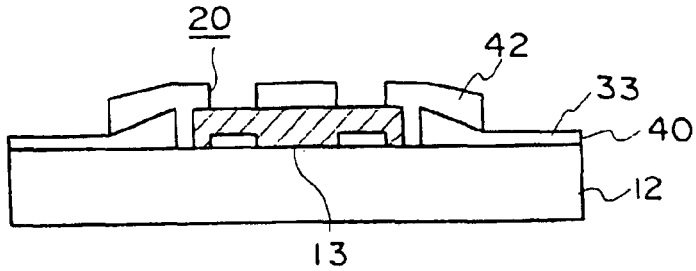

In FIGS. 9A and 9E, cross sectional views of an ink jet recording head relating to a fourth embodiment (a fourth manufacturing method) of the present invention are shown.

As shown in FIG. 9A, after a pattern 13 of the thick film resist is formed on the substrate 12, a resin 40 having photosensitivity is coated in a spin manner on the substrate 12.

Next, as shown in FIG. 9B, the photosensitive resin 40 in the vicinity of the pattern 13 of the thick film resist is removed by photolithography. Thus, a pattern 34 of the resist 40 having photosensitivity is formed.

Next, as shown in FIG. 9C, a resin 42 having photosensitivity is coated on the substrate 12 on which the pattern 34 of the resist 40 having photosensitivity is formed.

Next, as shown in FIG. 9D, a resist 30 is coated on the resin 42 having photosensitivity, patterning is carried out for the resist 30. Thus, a pattern 21 is formed.

Further, as shown in FIG. 9E, etching is carried with the pattern 21 being used as a mask. Thus, a removed region 33 is formed at a region external of the pattern 13 of the thick film resist (the ink chamber 24), and the ink discharge sections 20 are formed.

Here, in the patterning of the resin 42 having photosensitivity, it is possible not to carry out patterning of the resist 30. That is, exposing and developing are directly carried out for the resin 42 having photosensitivity, thereby the removed regions 33 and the ink discharge sections 20 are formed on the resin 42 having photosensitivity. In this case, the resin 40 having photosensitivity and the resin 42 having photosensitivity are both have negative-type photosensitivity.

Thereafter, an ink supply opining is formed on the substrate 12 by carrying out etching from a back side of the substrate 12. Next, the pattern 13 of the thick film resist is removed by dipping the substrate 12 in a thick film resist remover liquid. As a result, the ink chamber 24 is formed.

Because the of the structure mentioned above, in the vicinity of the ink chamber 24, there is no region which is not covered by the photosensitive resin 42. As a result, there is not dusty in the ink jet recording head. Therefore, the ink jet recording head of high reliability can be provided. Moreover, because thickness of the photosensitive resin 42 in the removed region 33 is thin, failure of the ink jet recording head, such as cracking caused by a difference between coefficients of thermal expansions of the substrate 12 and the resin having photosensitivity 42 (and the base 16), can be prevented.

Figure 10:
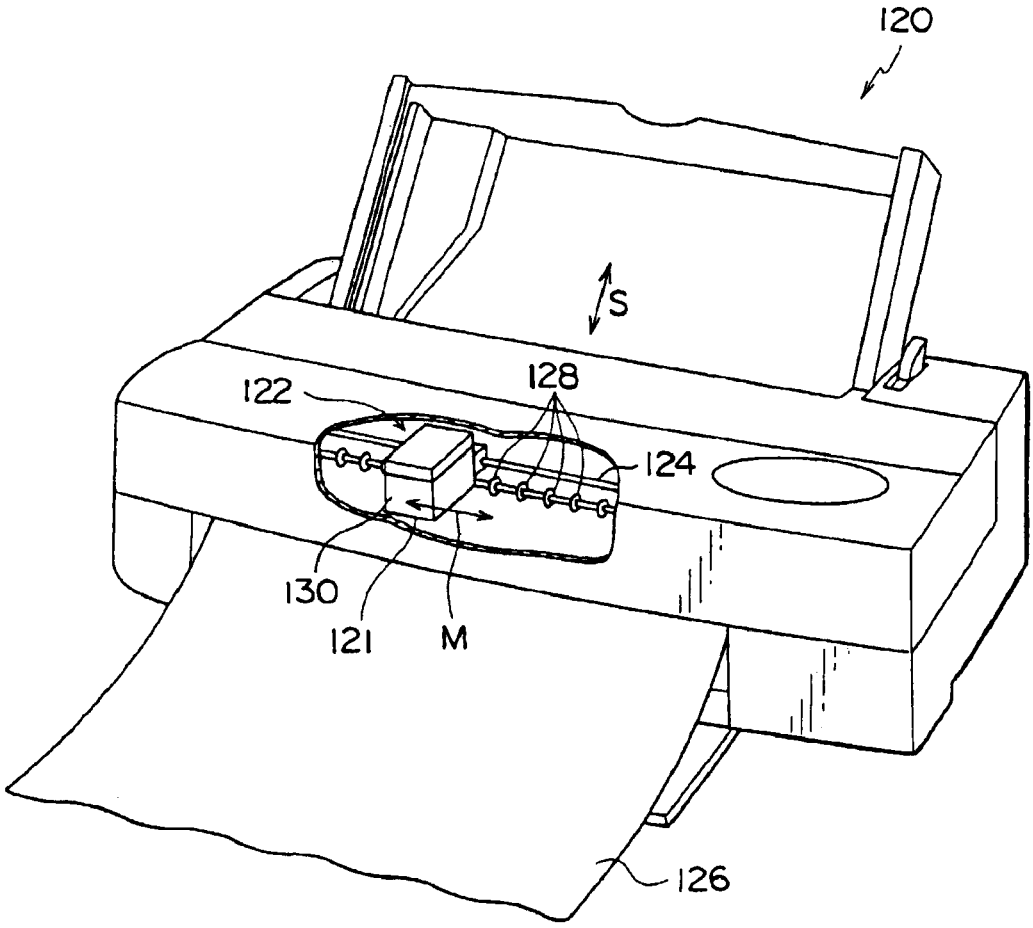
FIG. 10 is a perspective view of an ink-jet printer relating to an embodiment of the present invention.
Figure 11:
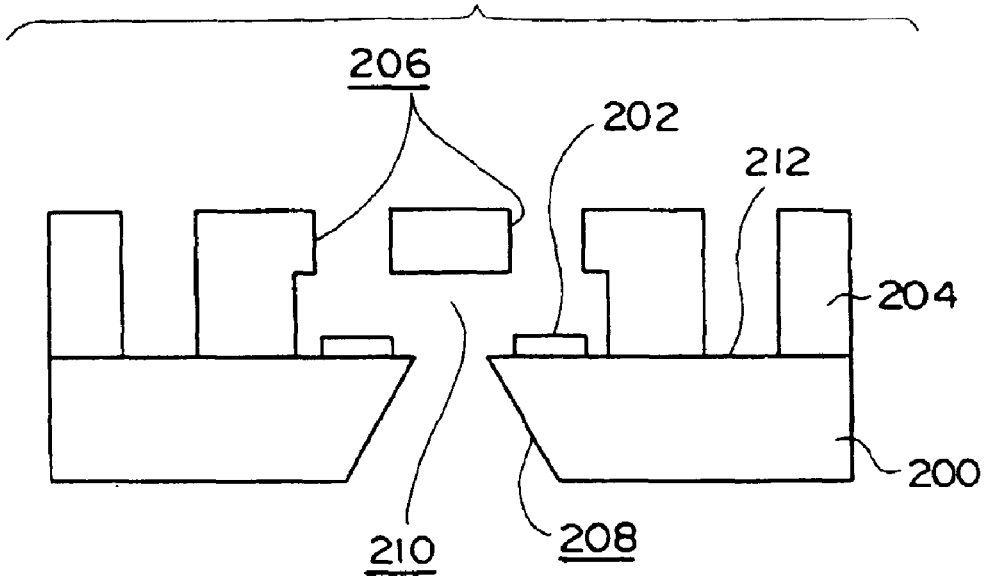
FIG. 11 is a cross sectional view which shows a conventional ink jet recording head.

In FIG. 10, an ink jet printer 120 relating to an embodiment of the present invention is shown.

As shown in FIG. 10, the ink jet printer 120 is provided with a carriage 122 on which an ink jet recording head 121 is mounted. The carriage 122 moves in a main scanning direction (a direction indicated by an arrow M) along a shaft 124 provided at the ink jet printer 120.

Further, conveyance rollers 128 for conveying a recording paper 126 are provided at the ink jet printer 120. The recording paper 126 is nipped by the conveyance rollers 128 and conveyed. Thus, the recording paper 126 moves in a sub scanning direction (a direction indicated by an arrow S).

The ink jet recording head 121 (the carriage 122) is provided with an ink tank 130. The ink jet recording head 121 is positioned at a side, facing the recording paper 126, of the ink tank 130, that is, a lower side of the ink tank 130 in FIG. 10. In the ink jet recording head 121 relating to the embodiment of the present invention, a longitudinal direction corresponds to the sub scanning direction and a short side direction corresponds to the main scanning direction. Therefore, in FIG. 10, the longitudinal direction is indicated by the arrow S and the short side direction is indicated by the arrow M.

In the embodiment, because of the structure mentioned above, the ink jet printer provided with the ink jet recording head in which a covering resin layer serving as an ink discharging surface can be flatly formed, there is not dusty, therefore high reliability is archived, can be provided.

In the present invention, because of the structures mentioned above, the ink jet recording head in which a particle made from an ink is hardly generated, and high reliability is archived, can be provided.

What is claimed is:

1. An ink jet recording head comprising:

a substrate;

a resin body, which defines an ink discharge section and an ink chamber, formed on the substrate;

a heating resistor provided on the substrate;

the ink chamber being formed between the heating resistor and the ink discharge section; and a resinous base which is formed on the substrate in the vicinity of the ink chamber, wherein a material of the resinous base is the same as that of the resin body, and the resinous base supports at least a portion of the resin body.

2. An ink jet recording head according to claim 1, wherein a height of the resinous base is substantially the same as that of the ink chamber.

3. An ink jet recording head according to claim 1, wherein the resin body is formed on the substrate after the resinous base is formed on the substrate.

4. An ink jet cartridge comprising an ink jet recording head comprising:

a substrate;

a resin body, which defines an ink discharge section and an ink chamber, formed on the substrate;

a heating resistor provided on the substrate, the ink chamber being formed between the heating resistor and the ink discharge section; and a resinous base which is formed on the substrate in the vicinity of the ink chamber, wherein a material of the resinous base is the same as that of the resin body, and the resinous base supports at least a portion of the resin body.

5. An ink jet printer comprising an ink jet recording head comprising:

a substrate;

a resin body, which defines an ink discharge section and an ink chamber, formed on the substrate;

a heating resistor provided on the substrate, the ink chamber being formed between the heating resistor and the ink discharge section; and a resinous base which is formed on the substrate in the vicinity of the ink chamber, wherein a material of the resinous base is the same as that of the resin body, and the resinous base supports at least a portion of the resin body.

* * * * *